US006925936B2

(12) United States Patent
Gottschalt et al.

(10) Patent No.: US 6,925,936 B2
(45) Date of Patent: Aug. 9, 2005

(54) IMAGING ASSEMBLY FOR IMAGING PRINTING PLATE INCLUDING MAGNETIC DRUM AND REGISTRATION SYSTEM

(75) Inventors: Oliver Gottschalt, Ludwigshafen (DE); Michael Kohlmann, Franenthal (DE); Erich Zahn, Eppelheim (DE)

(73) Assignee: Heidelberger Druckmaschinen AG, Heidelberg (DE)

( * ) Notice: Subject to any disclaimer, the term of this patent is extended or adjusted under 35 U.S.C. 154(b) by 0 days.

(21) Appl. No.: 09/833,349

(22) Filed: Apr. 12, 2001

(65) Prior Publication Data

US 2001/0047734 A1 Dec. 6, 2001

(30) Foreign Application Priority Data

Apr. 13, 2000 (DE) ..... 100 18 397

(51) Int. Cl.[7] ..... B41F 27/02

(52) U.S. Cl. ..... 101/477; 101/389.1; 101/415.1; 347/264

(58) Field of Search ..... 101/463.1, 465, 101/467, 389.1, 401.1, 415.1, 477; 347/262, 264; 492/8

(56) References Cited

U.S. PATENT DOCUMENTS

| | | | | | |
|---|---|---|---|---|---|
| 2,788,743 | A | * | 4/1957 | Schwerin | 101/389.1 |
| 3,271,226 | A | * | 9/1966 | Staehle et al. | 156/345.23 |
| 3,670,646 | A | * | 6/1972 | Welch, Jr. | 101/389.1 |
| 3,714,692 | A | * | 2/1973 | Bray | 492/8 |
| 4,116,594 | A | * | 9/1978 | Leanna et al. | 425/3 |
| 4,138,102 | A | * | 2/1979 | Palmer | 101/389.1 |
| 4,528,906 | A | * | 7/1985 | Hasegawa | 101/127.1 |
| 4,823,697 | A | | 4/1989 | Randazzo | 101/375 |
| 5,136,945 | A | * | 8/1992 | Kawazoe | 101/389.1 |
| 5,419,255 | A | * | 5/1995 | Reffert | 101/463.1 |
| 5,456,175 | A | * | 10/1995 | Haijima et al. | 101/170 |
| 5,479,859 | A | * | 1/1996 | Lindner et al. | 101/485 |
| 5,947,028 | A | * | 9/1999 | Montgomery et al. | 101/389.1 |
| 6,130,702 | A | * | 10/2000 | Ganton | 347/262 |
| 6,295,929 | B1 | * | 10/2001 | Tice et al. | 101/378 |

FOREIGN PATENT DOCUMENTS

| | | | |
|---|---|---|---|
| DE | 24 45 152 | A1 | 7/1975 |
| DE | 77 06 198 | U1 | 7/1978 |
| DE | 44 07 287 | A1 | 9/1995 |
| DE | 197 31 050 | C2 | 1/1999 |
| EP | 0 231 902 | B1 | 8/1987 |
| EP | 0 325 535 | B1 | 7/1989 |
| EP | 0 739 275 | B1 | 7/1995 |
| JP | 2001-293845 | * | 10/2001 |

* cited by examiner

*Primary Examiner*—Leslie J. Evanisko
(74) *Attorney, Agent, or Firm*—Laurence A. Greenberg; Werner H. Stemer; Ralph E. Locher

(57) ABSTRACT

A method of using a printing plate includes, in a first step, setting an image on the printing plate in an imaging machine, while holding the printing plate firmly on a magnetic cylinder of the imaging machine during the imaging process, and in a second step, printing in a printing machine with the printing plate having the image set in this manner; and an imaging machine and a printing machine for performing the method.

6 Claims, 5 Drawing Sheets

IMAGING ASSEMBLY FOR IMAGING PRINTING PLATE INCLUDING MAGNETIC DRUM AND REGISTRATION SYSTEM

BACKGROUND OF THE INVENTION

FIELD OF THE INVENTION

The invention relates to a method of using a printing plate, an imaging machine suitable for implementing the method and for setting an image on a printing plate, a printing machine suitable for implementing the method and having a magnetic cylinder for holding a printing plate, and a method of producing a printing plate formed as a flexographic printing plate.

The published German Patent Document DE 44 07 287 A1 describes a printing machine having a plate cylinder into which magnets are inserted for holding a register strip magnetically. The register strip is provided with register bars, over which register holes, which are formed in a printing plate, are disposed. The plate is formed of a relief body and a base body made with a material which is magnetically attractive, so that the plate is held magnetically by further magnets accommodated in a circumferential surface of the plate cylinder. A disadvantage of this printing machine is the manner of securing the plate, which is effected exclusively magnetically and is therefore inadequate for preventing separation from the plate cylinder during the printing process, wherein the plate is subjected to severe loads. Although the published or laid-open document mentions the possibility of sticking the plate onto the outer surface of the plate cylinder by using an adhesive layer, this would complicate the changing of the plate.

The published German Patent Document DE 77 06 198 U1 describes a cylinder formed with grooves fitted with permanent magnets for holding a printing plate, the grooves being arranged parallel to axial slots into which the ends of the plate are inserted and firmly clamped. Although this plate is adequately secured against detachment from the cylinder during the printing process by the firm clamping of the ends thereof, it is viewed as disadvantageous because it is not possible to provide an accurately positioned alignment of the plate in relation to the cylinder before the plate is firmly clamped. Consequently, firm clamping is often performed with an inaccurately aligned plate, so that loosening the firm clamping, correcting the alignment of the plate and firm clamping again are necessary, which increases the length of a changeover time.

Further prior art is described in the Published Non-prosecuted German Patent Application (DE-OS) 24 45 152, the published German Patent Document DE 689 06 168 T2 and U.S. Pat. No. 4,823,697.

SUMMARY OF THE INVENTION

It is accordingly an object of the invention to provide a method of using a printing plate, an imaging machine and a printing machine suitable for implementing the method, and a method of producing a flexographic printing plate whereon an image can be set in the imaging machine and which can be used in the printing machine.

With the foregoing and other objects in view, there is provided, in accordance with one aspect of the invention, a method of using a printing plate, which comprises, in a first step, setting an image on the printing plate in an imaging machine, while holding the printing plate firmly on a magnetic cylinder of the imaging machine during the imaging process, and in a second step, printing in a printing machine with the printing plate having the image set in this manner.

In accordance with another mode, the method of using includes, in the first step, attracting with the magnetic cylinder a magnetically attractable carrier layer of the printing plate, while setting the image on a printing layer applied to the carrier layer.

In accordance with a further mode, the method of using includes, in the second step, while printing with the printing plate, firmly holding the printing plate on a magnetic cylinder in the printing machine.

In accordance with an added mode, the method of using includes providing a flexographic printing plate as the printing plate.

In accordance with another aspect of the invention, there is provided an imaging machine for setting an image on a printing plate, comprising a magnetic cylinder for holding the printing plate firmly during the setting of an image thereon.

In accordance with another feature of the invention, the magnetic cylinder has a register system for aligning the printing plate.

In accordance with a further feature of the invention, the magnetic cylinder has at least one clamping device for firmly clamping the printing plate.

In accordance with an added feature of the invention, the magnetic cylinder has at least one permanent magnet for attracting the printing plate.

In accordance with a first alternative feature of the invention, the imaging machine is a plate-exposing machine.

In accordance with a second alternative feature of the invention, the imaging machine is a plate-developing machine.

In accordance with a third alternative feature of the invention, the imaging machine is a plate-engraving machine.

In accordance with a further aspect of the invention, there is provided a printing machine having a magnetic cylinder for holding a printing plate, the magnetic cylinder comprising a register system for aligning the printing plate, and at least one clamping device for firmly clamping the printing plate.

In accordance with another feature of the invention, the register system comprises register pins for engaging in register cut-outs formed in the printing plate.

In accordance with a further feature of the invention, the register cut-outs are formed in a dimensionally stable carrier layer of the printing plate, and a printing layer is permanently joined to the carrier layer.

In accordance with an added feature of the invention, the clamping device has a clamping jaw for clamping one end of the printing plate.

In accordance with an additional feature of the invention, the magnetic cylinder is formed with a circular circumferential line, and the printing plate held by the magnetic cylinder extends partly bent over under the circular circumferential line of the magnetic cylinder.

In accordance with a third aspect of the invention, there is provided a method of producing a flexographic printing plate, which comprises firmly joining to a carrier layer of the flexographic printing plate a printing layer having no image yet set thereon, and then setting an image on the printing layer.

In accordance with another mode, the producing method includes, before joining the printing layer to the carrier layer, setting an image on a rear side of the printing layer, and curing it thereby and, after the printing layer has been joined to the carrier layer, setting an image on a front side of the printing layer.

In accordance with a further mode, the producing method includes, while setting an image on the flexographic printing plate, firmly holding the plate on a rotating cylinder.

In accordance with an added mode, the producing method includes providing a magnetic cylinder as the rotating cylinder.

In accordance with an additional mode, the producing method includes providing the cylinder as a constituent part of an imaging machine provided for setting an image digitally on the flexographic printing plate.

In accordance with a concomitant mode, the producing method includes, before setting an image on the printing layer, forming register cut-outs in the carrier layer.

Thus, the method according to the invention for using a printing plate is distinguished by the fact that, in a first method step, the printing plate has an image set thereon in an imaging machine, the printing plate being held firmly on a magnetic cylinder of the imaging machine during this imaging process and that, in a second method step, printing is performed in a printing machine with the printing plate having an image set thereon in this manner.

An advantage of the method according to the invention is in the fact that it permits a permanent connection, carried out, for example, by adhesive bonding, between a printing layer whereon an image is to be set on the printing plate and a dimensionally stable carrier layer of the printing plate, so as to form a composite or sandwich structure provided with register cut-outs before imaging in the imaging machine. Setting an image on the printing layer can be performed with the carrier layer already firmly and permanently connected to the printing layer in the imaging machine equipped with a register system corresponding with the register cut-outs and including register pins, so that the occurrence of positional deviations of the aforementioned plate layers relative to one another, which lead to printing faults, is ruled out both during and after the setting of an image. This is an important advantage by comparison with heretoforeknown methods of using a printing plate, wherein, first of all, a printing layer separate from a carrier layer has an image set thereon and, after the imaging process, the printing layer is mounted permanently on the carrier layer, for example, adhesively bonded on, and wherein there is a risk of expansion or slipping of the printing layer relative to the carrier layer during assembly, which causes printing faults during printing.

The imaging machine according to the invention for setting an image on a printing plate is distinguished by the fact that the imaging machine has a magnetic cylinder for holding the printing plate firmly during the setting of an image.

The imaging machine according to the invention is particularly suitable for implementing the method according to the invention.

A further advantage of the imaging machine according to the invention is in that the magnetic cylinder with the printing plate, which is preferably a flexographic printing plate, can rotate during the imaging operation at a very high speed of more than 1,000, preferably more than 1,500 and, for example, about 2,000 revolutions per minute, so that the complete operation of setting an image on the printing plate can be performed within an extremely short time period.

Such high rotational speeds of printing plates, during the setting of an image thereon, have been attained, prior to the invention of the instant application, only in imaging machines for setting an image on flexographic printing sleeves (flexosleeves) and not when setting an image on flexographic printing plates.

Another advantage of the imaging machine according to the invention is that the preparation of the printing plate is technologically simple. In order to hold the printing plate magnetically firmly, the plate merely has to be formed to some extent of a magnetic or ferromagnetic material. This material can be distributed in particulate form, for example, as iron filings, within a rubber or polymer layer on the printing plate. The magnetically attractable material can also form the flat carrier layer of the printing plate, mentioned hereinbefore, in the form of a steel sheet.

The printing machine according to the invention having a magnetic cylinder to hold a printing plate is distinguished by the fact that the magnetic cylinder has both a register system for aligning the printing plate and at least one clamping device for firmly clamping the printing plate.

An advantage of the printing machine according to the invention is in the high suitability thereof for implementing the method according to the invention.

A further advantage of the printing machine according to the invention is that the printing plate, preferably formed as a flexographic printing plate, is secured, to a sufficient extent against separating from the magnetic cylinder during the printing process, by the clamping device and, after the printing process, uncomplicated changing of the printing plate is nevertheless possible. Likewise advantageous with the printing machine according to the invention is that, by employing the register system, the printing plate can be positioned accurately relative to the magnetic cylinder before being firmly clamped, so that no positional corrections of the printing plate are necessary after the latter has once been clamped firmly.

The method according to the invention for producing a flexographic printing plate is distinguished by the fact that firstly, on the flexographic printing plate, a printing layer with no image yet set is firmly joined to a carrier layer of the flexographic printing plate, and then an image is set on the printing layer.

An advantage of the production method according to the invention is in the fact that the flexographic printing plate produced therewith is very suitable for use in the imaging machine according to the invention and in the printing machine according to the invention.

A further advantage of the production method according to the invention is in that the occurrence of positional deviations of the printing layer relative to the carrier layer, which are caused by mounting the printing layer on the carrier layer and lead to printing faults, are ruled out absolutely. The necessity for compensating for register inaccuracies, in particular for diagonal register faults, in the printing machine can be reduced considerably by comparison with the heretoforeknown production methods for flexographic printing plates. Any diagonal register faults which can still result from other circumstances, but no longer from the assembly, are generally less than 1 millimeter and can easily be corrected.

Other features which are considered as characteristic for the invention are set forth in the appended claims.

Although the invention is illustrated and described herein as a method of using a printing plate, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings, wherein:

DESCRIPTION OF THE PREFERRED EMBODIMENTS

Figure 1:
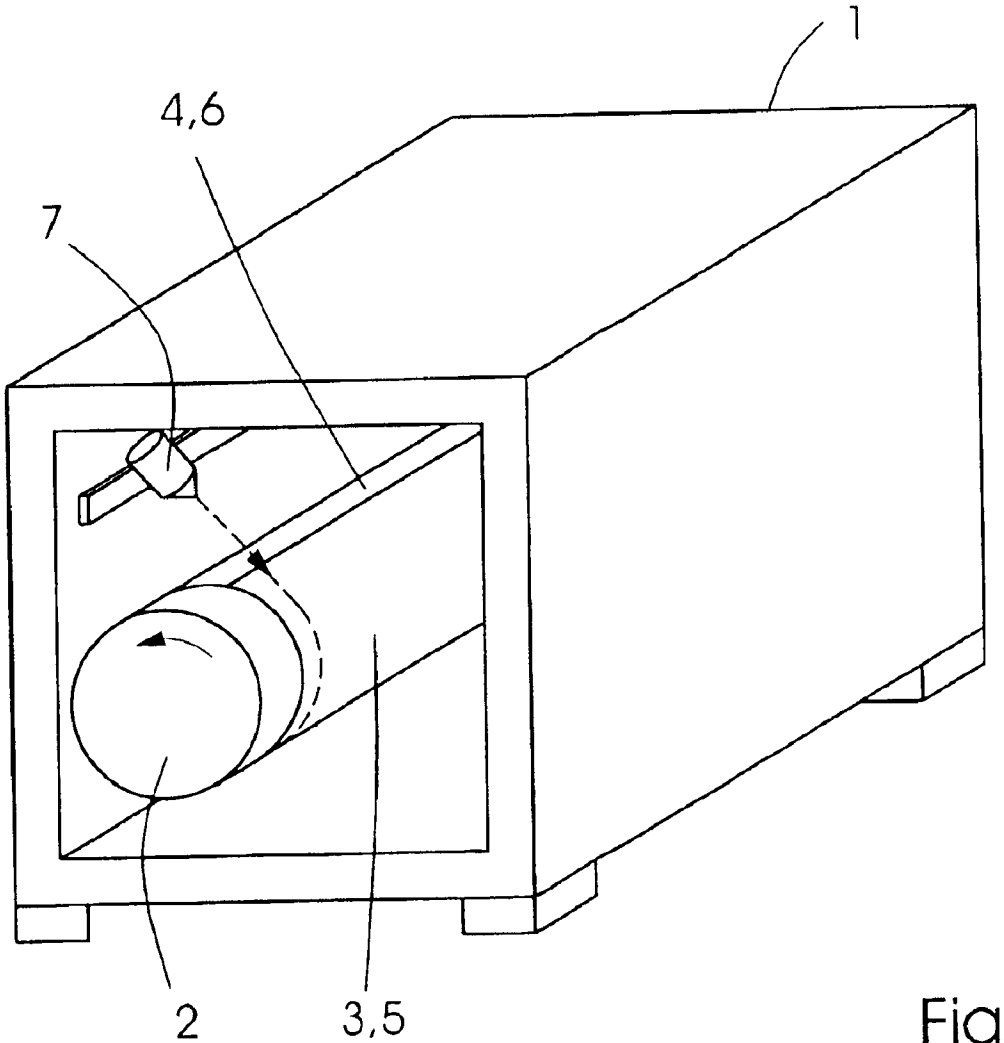
FIG. 1 is a diagrammatic front, side and top perspective view of an imaging machine having a magnetic cylinder and a printing plate clamped onto the magnetic cylinder while an image is being set on the printing plate.

Referring now to the drawings and, first, particularly to FIG. 1 thereof, there is illustrated therein an imaging machine 1 having a rotating magnetic cylinder 2, which holds a printing plate 3 by magnetic attraction on the circumferential surface thereof. The printing plate 3 is a flexographic printing plate and is formed of a carrier layer 4 which is dimensionally stable and, nevertheless, is bendable around the magnetic cylinder 2, and a printing layer 5 which is non-destructively and non-detachably joined to the carrier layer 4, for example, by adhesive bonding, and often referred to as a printing block or cliché. Before the printing layer 5 was joined to the carrier layer 4, a rear side of the printing layer 5 was exposed over virtually the entire area thereof to ultraviolet (UV) light, in order to create a cured and stable base layer within the printing layer 5 for the elevated printing-image areas. The carrier layer 4 is formed of a material which can be attracted magnetically by the magnetic cylinder 2 and can have magnetic or ferromagnetic properties. The carrier layer 4 is preferably formed as a thin steel sheet. The printing layer 5 is formed of a flexible plastic material, elastomer, polymer, silicone or rubber and leaves an uncovered edge strip 6 of the carrier layer 4 free.

Also conceivable is a multilayer construction of the printing layer 5 (a so-called sandwich construction), for example, of two differently compressible types of plastic material.

In a construction of the imaging machine 1 as a digital plate-exposer, the printing layer 5 may be formed of a photopolymer, which is exposed locally to UV light by an imaging tool 7, which cures printing-image areas on the printing layer 5 and forms a latent printing image, not yet ready to print, on the printing plate 3.

The imaging machine 1 may also be a developing machine, however, by which the aforementioned latent printing image is developed, due to the fact that the non-printing areas on the printing layer 5, which have not been exposed to the UV light, are deepened. If the deepening of the non-printing areas is performed by a washing process, the imaging tool 7 in the imaging machine 1 constructed as a developing machine may be a rotating brush, which removes the material of the printing layer 5 located between the printing image areas. If the removal of the non-exposed and non-cured polymer from the printing layer 5 is performed by blowing it away, the imaging tool 7 in the imaging machine 1 constructed as a developing machine may be an air knife. Regardless of whether the development of the latent printing image on the printing layer 5 is performed by washing out or blowing away material in the printing layer 5 which was not cured by the exposure, the result, in any case, is a relief on the printing layer 5 which corresponds to the printing image and is formed by the elevated printing-image areas which have been cured and have accordingly remained in place.

The imaging machine 1 can also be constructed, however, as a digital engraving machine, by which non-printing areas are engraved as depressions into the printing layer 5. A printing layer 5 formed of rubber or an elastomer is particularly suitable for imaging by engraving. In the imaging machine 1 constructed as an engraving machine, the imaging tool 7 may be a laser, preferably a YAG or $CO_2$ laser, by the laser beam of which the printing layer 5 is deepened at the non-printing areas, due to the fact that the laser beam partly burns and evaporates the printing layer 5 at these areas.

The imaging machine 1 is preferably used for setting an image digitally on the printing plate 3 (computer-to-plate).

Regardless of whether the imaging machine 1 is constructed as the plate-exposing machine, the developing machine or the engraving machine, the printing plate 3 rotates with the magnetic cylinder 2, firmly held magnetically on the latter during the imaging process, i.e., during the exposure, the washing out, the blowing away or the engraving, while the imaging tool 7 acts upon the printing layer 5 and, precisely stated, on the front side of the latter.

Figure 2:
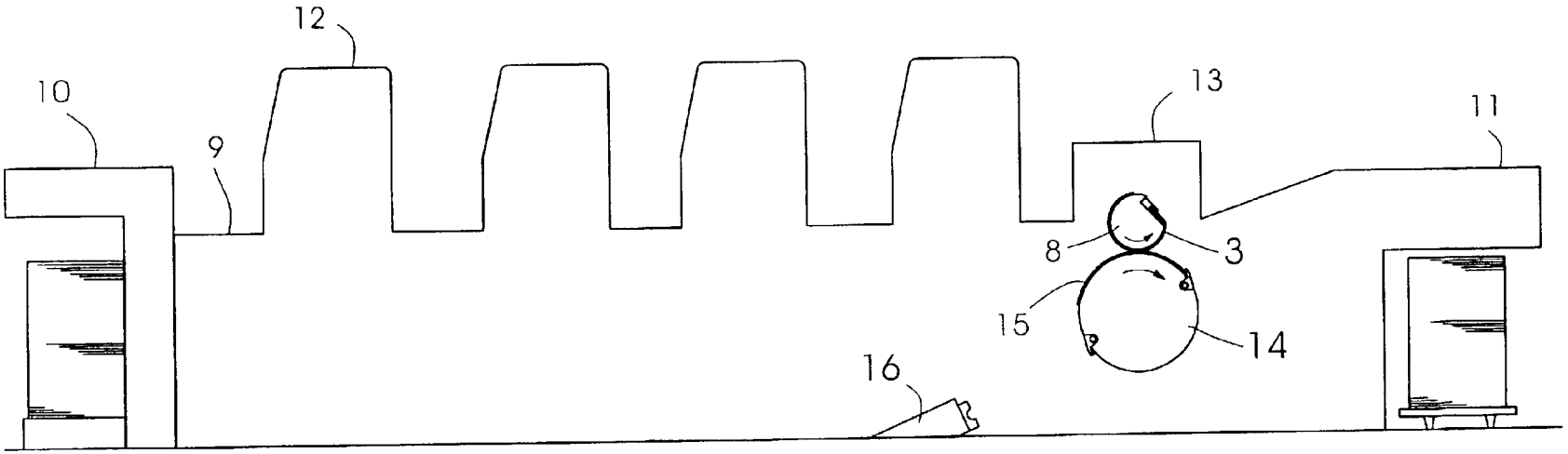
FIG. 2 is a diagrammatic side elevational view of a printing machine having a magnetic cylinder, to which the printing plate of FIG. 1 is fixed after having an image set thereon by the imaging machine.

After an image has been set on the printing plate 3, the latter can be removed from the magnetic cylinder 2, taken out of the imaging machine 1 and fixed to a magnetic cylinder 8 of a printing machine 9 shown in FIG. 2.

The printing machine 9, constructed as a rotary printing machine, includes a sheet feeder 10, a sheet delivery 11, at least one offset printing unit 12 and a flexographic printing unit 13 which is used as a varnishing unit and which contains the magnetic cylinder 8 with the printing plate 3 located thereon, which is used as a varnishing plate and set with an image ready for printing. The magnetic cylinder 8 is used as an applicator cylinder for applying a varnish or comparable liquid coating to a sheet printing material 15 which, in the process, is transported past the magnetic cylinder 8 by an impression cylinder 14 associated with the magnetic cylinder 8. FIG. 2 illustrates the magnetic cylinder 8 with the printing plate 3 already fastened thereon.

Figure 3:
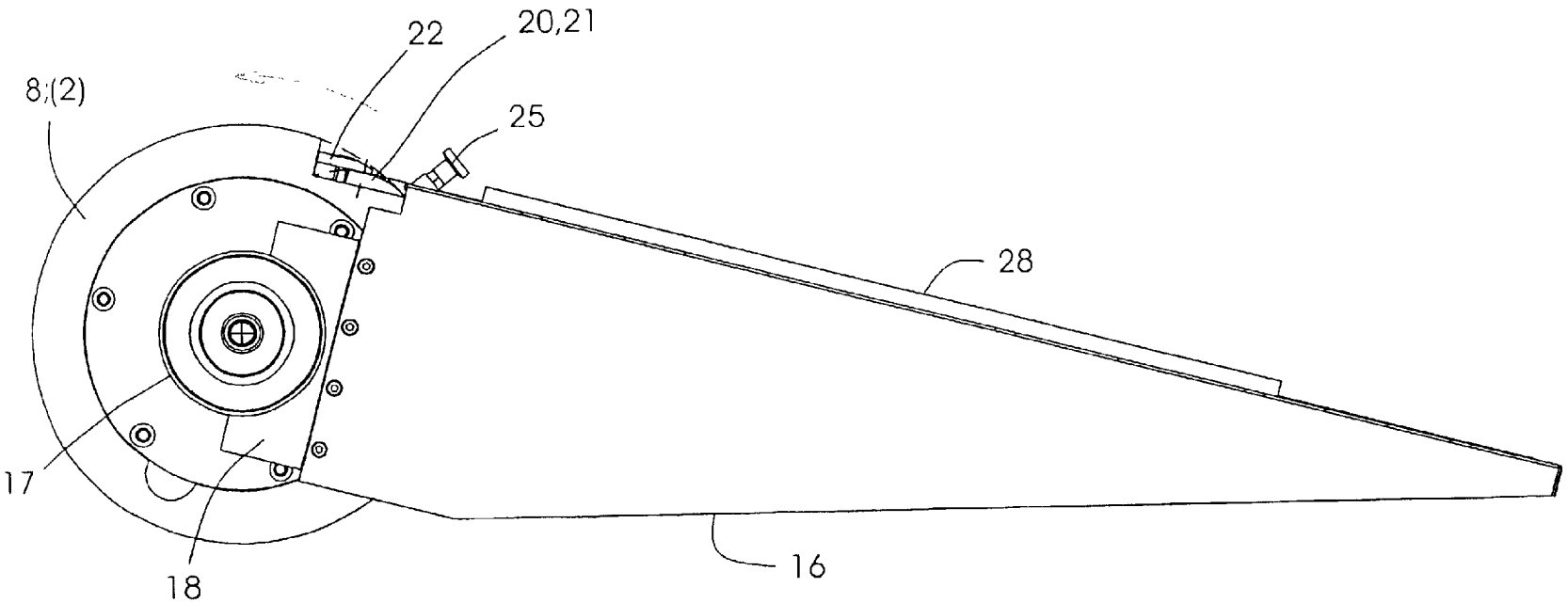
FIG. 3 is an enlarged fragmentary view of FIG. 2, rotated through 180° and showing a plate feeding device and the magnetic cylinder of the printing machine.
Figure 4:
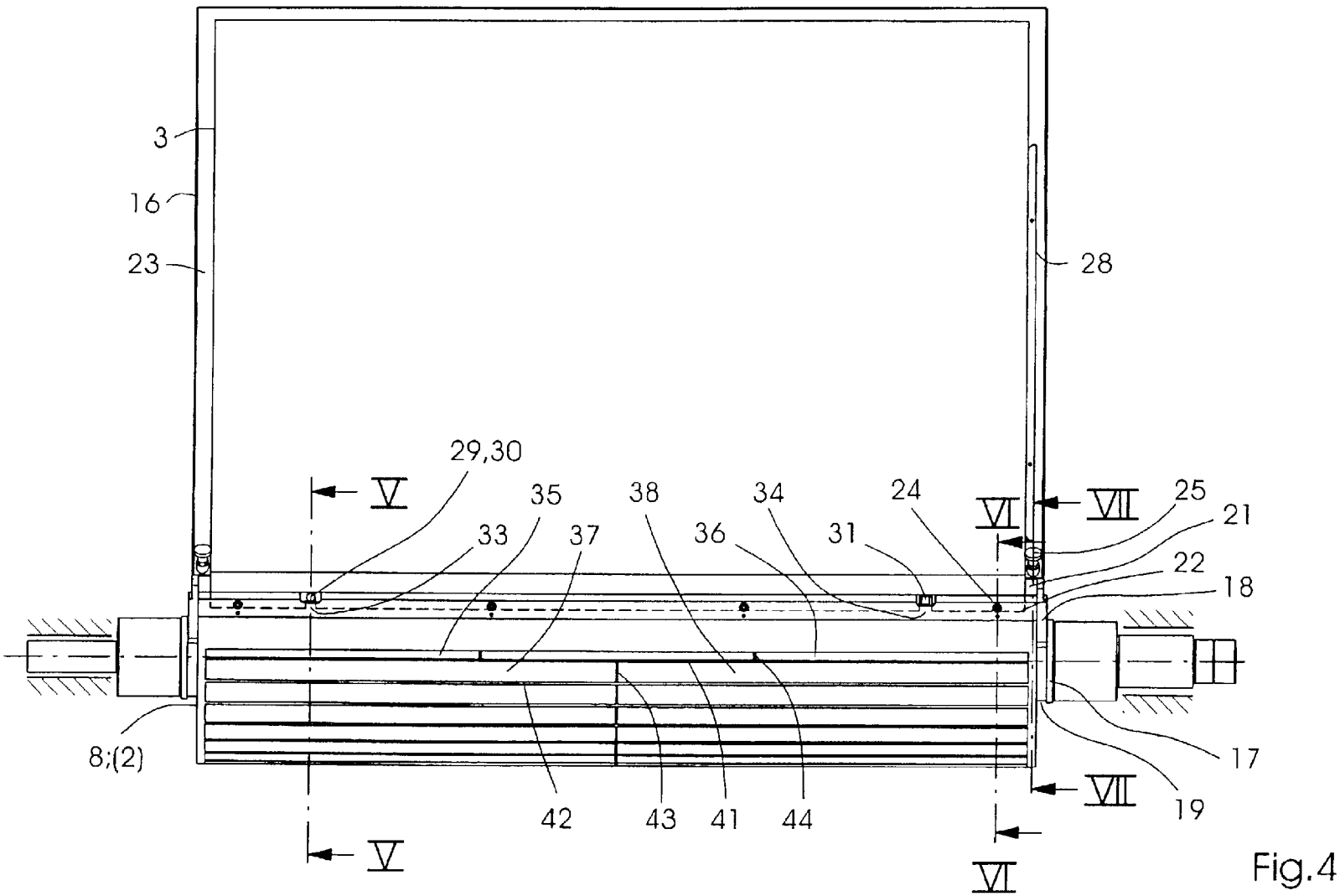
FIG. 4 is a reduced top plan view as seen from the lefthand side of FIG. 3 and showing the magnetic cylinder and the plate feeding device.

FIGS. 3 and 4 depict a method step preceding the state of FIG. 2 wherein the printing plate 3 is fixed to the magnetic cylinder 8. As shown in FIGS. 3 and 4, a plate feeding device or feeder 16 constructed as a feed table can be set against the magnetic cylinder 8 from time to time. The plate feeding device 16, after fulfilling the purpose thereof, which is further explained hereinbelow, can be taken away from the magnetic cylinder 8 again and, for example, put down on the floor, as shown in FIG. 2. When the plate feeding device 16 is set against the magnetic cylinder 8 (note FIGS. 3 and 4), it is supported at both ends of the magnetic cylinder 8 on a support 17 formed, respectively, by a shaft or axle journal of the magnetic cylinder 8. For this purpose, the plate feeding device 16 has, at each end thereof, a supporting shell 18, having a concave rounding which rests on the support 17 and partly surrounds the latter with an in-register or exact fit. The cheek-shaped supporting shell 18 engages in an annular groove 19 formed in the support 17.

When the plate feeding device 16 is resting against the support 17, it is possible to rotate the magnetic cylinder 8 about the central axis thereof until a clamping device 20 belonging to the magnetic cylinder 8 is located in a rotary position relative to the plate feeding device 16 which is suitable for the printing plate 3 resting on the plate feeding device 16 to be inserted into the clamping device 20. The suitable rotary position is reached when an opening between clamping faces of a rail-like clamping support 21 and a clamping jaw 22 which can be moved relative to the clamping support 21 and belongs to the clamping device 20 is located in a straight or vanishing line of a supporting face 23 of the plate feeding device 16. When the magnetic cylinder 8 and the plate feeding device 16 assume this position relative to one another, the printing plate 3 on the supporting face 23 can be pushed into the clamping device 20 in a direction towards the magnetic cylinder 8 and between the clamping support 21 and the clamping jaw 22 until the printing plate 3 reaches a clamping position, having been pushed in a straight line and without any deformation of the flat printing plate 3. When, after reaching the clamping position, a front plate edge of the printing plate 3, formed by the edge strip 6, is located between the clamping support 21 and the clamping jaw 22, the clamping jaw 22 is pressed against the edge of the plate and against the clamping support 21 by tightening a screw 24 belonging to the clamping device 20 and passing through the clamping jaw 22, which clamps the printing plate 3 firmly.

In order to secure the relative position between the magnetic cylinder 8 and the plate feed device 16 required in order to insert the printing plate 3 into the clamping device 20, the plate feeding device 16 has, at each end thereof, a securing device 25, respectively, formed as a latch. The securing device 25 includes a latching pin 26 which is spring-loaded on the plate feeding device 16 in a direction towards the magnetic cylinder 8 and fitted so that it can be moved on the plate feeding device 16 and which, when the magnetic cylinder 8 is rotated into the required relative position, slides along on the circumferential surface of the magnetic cylinder 8 and, as a result of the spring loading thereof, latches into a latching hole 27 or latching groove which is formed in the circumferential surface of the magnetic cylinder 8, the instant of time that the magnetic cylinder 8 has reached the required rotary position. The latching pin 26, constructed as a so-called spring pin, can be pulled out of the latching hole 27, overcoming the spring loading, after the printing plate 3 has been firmly clamped on the magnetic cylinder 8, so that the magnetic cylinder 8 can again be rotated in relation to the plate feeding device 16. When the printing plate 3 is being displaced on the supporting face 23, one side edge of the printing plate 3 is guided perpendicularly to the axis of rotation of the magnetic cylinder 8 by a rail-like side stop 28 arranged on the supporting face 23.

The magnetic cylinder 8 is equipped with a register system 29, which includes register pins 30 and 31. Each of the register pins 30 and 31 protrudes from the clamping support 21 and, with the head thereof, into a cut-out 32 formed in the rail-like clamping jaw 22. Each of the register pins 30 and 31 engages in a respective U-shaped register cut-out 33, 34, which is cut out of the edge of the plate formed by the edge strip 6 and, for example, has been stamped out of the carrier layer 4 before the image was set on the printing layer 5 in the imaging machine 1. When the printing plate 3 is being displaced on the supporting face 23 thereof into the clamping device 20, the register cut-outs 33 and 34, which are open towards the clamping device 20 in the thrust direction of the printing plate 3, are slipped over the register pins 30 and 31, the center spacing of which corresponds to the register cut-outs 33 and 34, so that inner edges of the register cut-outs 33 and 34 come to rest against the register pins 30 and 31, which aligns the printing plate 3 accurately in register relative to the magnetic cylinder 8 before it is firmly clamped. Introducing the register cut-outs 33 and 34 into the carrier layer 4, which is formed of sheet steel, ensures high dimensional stability of the register cut-outs 33 and 34. After the printing plate 3 has been clamped firmly in the clamping device 20, the magnetic cylinder 8 is rotated in counterclockwise direction with respect to FIG. 3, so that the magnetic cylinder 8 pulls the printing plate 3 off the plate feeding device 16, and the printing plate 3 nestles over the length thereof against the circumferential surface of the magnetic cylinder 8, it being possible for this action of pulling on the printing plate 3 to be supported by an element, for example, a pressing roller, which presses the printing plate against the magnetic cylinder 8.

The magnetic cylinder 8 is fitted with magnets 35 to 40, which are arranged in rows parallel to the axis of the magnetic cylinder 8 and in rows extending in the circumferential direction of the magnetic cylinder 8. The magnets 35 to 40 are permanent magnets, which are embedded in the circumferential surface of the magnetic cylinder 8 so that they terminate flush with this circumferential surface, the individual magnets 35 to 40 being separated from one another by longitudinal webs 41 and 42 and by transverse webs 43 and 44 belonging to the magnetic cylinder 8. The material of the magnets 35, 36 and 40 located closest to the clamping device 20 is more highly magnetized than the material of the magnets 37 to 39, which are the same size as one another, are arranged between the magnets 35, 36 and 40 and are distributed at constant intervals over the circumference of the magnetic cylinder 8. The magnetic field or the energy density and the magnetic attraction of each of the magnets 35, 36 and 40 which are immediately adjacent to the clamping device 20 and, for example, can be neodymium-iron-boron or samarium-cobalt magnets, is therefore greater than the magnetic field and the attraction of the other magnets 37 to 39 which are placed farther away from the clamping device 20 and which, for example, can be hard ferrite magnets.

In an embodiment which differs from the illustrated exemplary embodiment, electromagnets can also be used instead of the permanent magnets, being constructed so as to correspond to the permanent magnets in terms of the arrangement in rows and magnetic strength, and being capable of being switched on and off as required. The permanent magnets and electromagnets can also be fixed in combination to the magnetic cylinder 8.

Figure 5:
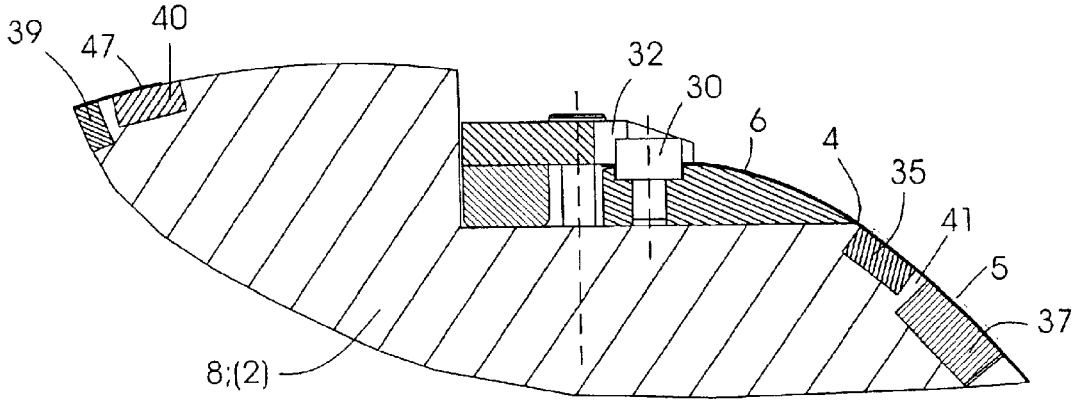
FIGS. 5 to 7 are various sectional views of FIG. 4 taken along the section lines V—V, VI—VI and VII—VII, respectively, through a clamping device belonging to the magnetic cylinder of the printing machine.
Figure 6:
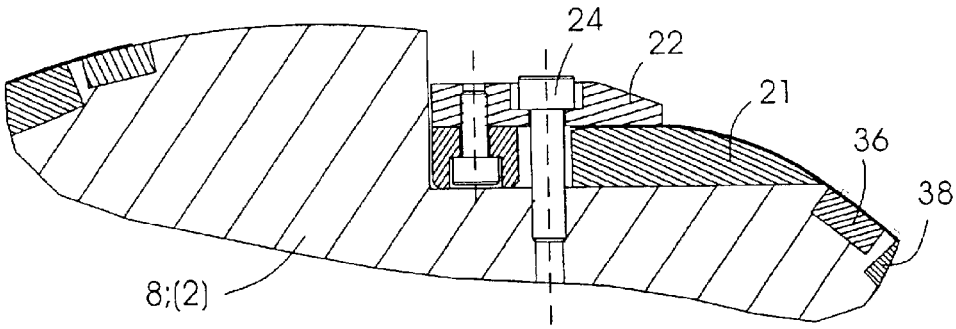
Figure 7:
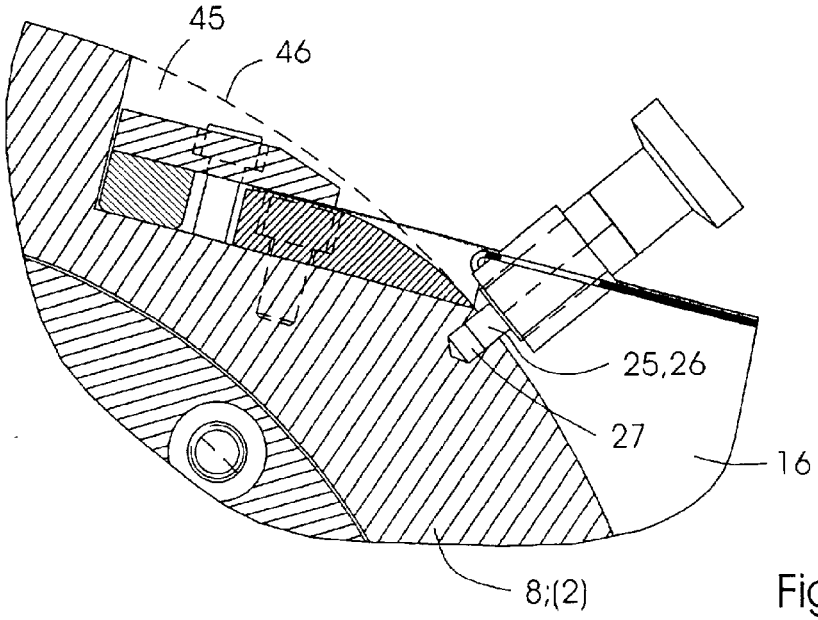

When the magnetic cylinder 8 assumes that rotary position relative to the plate feeding device 16 which is determined by the securing device 25, there is, on a circumferential section of the magnetic cylinder 8 which is formed by the clamping support 21 and located between the plate feeding device 16 and the clamping device 20, no magnet which would be capable of pulling the front edge of the printing plate 3, which projects beyond the supporting face 23 in the direction of the clamping device 20, into contact with the magnetic cylinder 8, i.e., onto the clamping support 21. In other words, between the clamping jaw 22 and the register system 29, on the one hand, and the plate feeding device 16, on the other hand, there is a virtually magnet-free zone of the magnetic cylinder 8. This magnet-free zone has the effect that the plate edge firmly clamped in the clamping device 20 springs away from the magnetic cylinder 8 the instant that the clamping device 20, arranged in an axially parallel cylinder channel 45 underneath a circular circumferential line 46 of the magnetic cylinder 8, is opened sufficiently far enough. The fact that the plate edge springs away is advantageous with regard to the automated removal of the printing plate 3 from the magnetic cylinder 8, in particular, when the plate feeding device 16 is a constituent part of an automatic plate-feeding and removing device. In addition, the magnet-free zone indicates that the front edge of the printing plate 3 is virtually uninfluenced magnetically when the printing plate 3 is placed in-register against the magnetic cylinder 8, so that contact errors caused by magnetic forces are avoided. As can best be seen from FIG. 5, only the front edge of the plate, formed by the edge strip 6, is firmly clamped, and an unclamped rear edge 47 of the printing plate 3 is held on the magnetic cylinder 8 only by the action of the magnet 40.

In an embodiment which differs from the exemplary embodiment shown with the freely trailing plate edge 47, the rear edge of the plate can be firmly clamped in a further clamping device in a manner comparable to the clamping of the front plate edge.

Although, in the exemplary embodiment shown, when the printing plate 3 is fixed to the magnetic cylinder 8, the edge strip 6 is subsequently elastically deformed from the circular circumferential line 46, changing into a secant following the clamping support 21, and is bent over into the cylinder channel 45, this elastic deformation returns completely after the clamping device 20 has been opened, so that the printing plate 3, both before and after being fixed to the magnetic cylinder 8, has a leading edge which is stretched and not bent over, and a similar trailing edge. This flat form of the printing plate 3 is advantageous with respect to the ability thereof to be stacked and clamped repeatedly onto the magnetic cylinder 8.

At this point, mention should be made of the fact that, in contrast with the exemplary embodiment shown, a cylinder holding the printing plate 3 by electrostatic attraction can also be provided instead of the magnetic cylinder 8. This cylinder has a clamping device corresponding to the clamping device 20 and, instead of the magnets 35 to 40, has a circumferential surface which can be charged up with an electrical charge. The printing plate 3 and, in particular, the carrier layer 4 thereof is provided with a charge having a polarity opposite to that of the circumferential surface of the cylinder. Between the printing plate 3 and the carrier layer 4, on the one hand, and the circumferential surface of the cylinder, on the other hand, a film-like electrical insulator is inserted as an interlayer between the printing plate 3 and the cylinder.

The magnetic cylinder 2 in the imaging machine 1 shown in FIG. 1 is completely identical in terms of function and construction with the magnetic cylinder 8 of the printing machine 9. For example, both magnetic cylinders 2 and 8 have the same diameter and are equipped with identical register systems. In addition, a plate feeding device corresponding to the plate feeding device 28 is also assigned to the magnetic cylinder 2. The illustration of FIGS. 3 to 7 and the description of the magnetic cylinder 8 given in relation to FIGS. 3 to 7 can therefore readily be transferred to the magnetic cylinder 2, so that the latter does not have to be shown and described again in detail. The possibility of this transfer is indicated in FIGS. 3 to 7 by a reference symbol "(2)" placed after the reference numeral 8 and representing the magnetic cylinder 2. Likewise, the embodiments mentioned with regard to modifications of the magnetic cylinder 8 but not shown can be transferred to the magnetic cylinder 2, for example, in the sense that the latter can likewise be replaced by the electrostatically attracting cylinder.

We claim:

1. An imaging assembly, comprising a printing plate, and an imaging machine for setting an image on said printing plate, said printing plate formed of a magnetically attractable material, said imaging machine including a magnetic cylinder magnetically holding said printing plate firmly during the setting of an image thereon, said magnetic cylinder having at least one magnet for attracting said printing plate magnetically and being selected from the group consisting of permanent magnets and electromagnets, said magnetic cylinder having a register system aligning said printing plate, and said printing plate having an edge, and substantially U-shaped register cut-outs being disposed in said edge.

2. The assembly according to claim 1, wherein said magnetic cylinder has at least one clamping device firmly clamping said printing plate.

3. The assembly according to claim 1, wherein said magnet for said magnetic cylinder comprises at least one permanent magnet magnetically attracting said magnetically attractable printing plate.

4. The assembly according to claim 1, wherein said imaging machine is a plate-exposing machine.

5. The assembly according to claim 1, wherein said imaging machine is a plate-developing machine.

6. The assembly according to claim 1, wherein said imaging machine is a plate-engraving machine.

* * * * *